US009156132B2

(12) United States Patent
Yamamoto et al.

(10) Patent No.: US 9,156,132 B2
(45) Date of Patent: Oct. 13, 2015

(54) SURFACE TREATMENT MACHINE

(75) Inventors: Shigeru Yamamoto, Toyokawa (JP); Tadanobu Oyama, Toyokawa (JP)

(73) Assignee: SINTOKOGIO, LTD., Nagoya-Shi (JP)

( * ) Notice: Subject to any disclaimer, the term of this patent is extended or adjusted under 35 U.S.C. 154(b) by 285 days.

(21) Appl. No.: 13/504,714

(22) PCT Filed: Mar. 1, 2011

(86) PCT No.: PCT/JP2011/054626

§ 371 (c)(1),
(2), (4) Date: Jul. 10, 2012

(87) PCT Pub. No.: WO2012/014514

PCT Pub. Date: Feb. 2, 2012

(65) Prior Publication Data

US 2013/0115853 A1 May 9, 2013

(30) Foreign Application Priority Data

Jul. 29, 2010 (JP) ..... 2010-171022

(51) Int. Cl.

| | |
|---|---|
| ***B24C 3/00*** | (2006.01) |
| ***B24C 3/08*** | (2006.01) |
| ***B24C 9/00*** | (2006.01) |
| ***B24C 3/06*** | (2006.01) |

(52) U.S. Cl.

CPC ... *B24C 3/00* (2013.01); *B24C 3/06* (2013.01); *B24C 3/08* (2013.01); *B24C 9/00* (2013.01)

(58) Field of Classification Search

CPC ..... B24C 3/00; B24C 3/08; B24C 3/06; B24C 9/00

USPC ..... 451/80–84, 89, 2, 5, 6, 8, 11, 75; 198/502.2, 495, 341.04, 341.05

See application file for complete search history.

(56) References Cited

U.S. PATENT DOCUMENTS

| | | | | |
|---|---|---|---|---|
| 2,073,184 | A * | 3/1937 | Schweitzer | 451/81 |
| 3,031,802 | A * | 5/1962 | Leliaert | 451/80 |

(Continued)

FOREIGN PATENT DOCUMENTS

| | | |
|---|---|---|
| CN | 2181368 Y | 11/1994 |
| JP | 04-256578 | 9/1992 |

(Continued)

OTHER PUBLICATIONS

International Search Report dated Jun. 7, 2011 issued in International Application No. PCT/JP2011/054626, 4 pages.

*Primary Examiner* — Lee D Wilson
*Assistant Examiner* — Henry Hong
(74) *Attorney, Agent, or Firm* — Finnegan, Henderson, Farabow, Garrett & Dunner, L.L.P.

(57) ABSTRACT

Disclosed herein is a surface treatment machine that enables the inhibition or reduction of residual abrasives that remain on a workpiece that has been surface treated. An H steel (a workpiece to be treated) 12 is conveyed by means of a conveying device 20. Blasting devices 24A, 24B are then projected abrasives on to the conveying H steel such that it is surface treated. In the downstream of the blasting devices 24A, 24B along the conveying direction, a blowing port 30A of an air blower 30 is located above a conveying path to blow gas to the upper surface 112A of the H steel 12 such that the abrasives on the H steel 12 are blown off and removed therefrom.

17 Claims, 5 Drawing Sheets

(56) References Cited

U.S. PATENT DOCUMENTS

| | | | | |
|---|---|---|---|---|
| 3,824,738 | A * | 7/1974 | Hall et al. | 451/76 |
| 5,107,629 | A * | 4/1992 | Boyd et al. | 451/38 |
| 5,371,974 | A * | 12/1994 | Lecerf et al. | 451/5 |
| 6,688,458 | B2 * | 2/2004 | Prentice et al. | 198/502.2 |
| 2004/0048555 | A1 * | 3/2004 | Jinbo | 451/43 |
| 2005/0155692 | A1 * | 7/2005 | Arai et al. | 156/64 |
| 2011/0039481 | A1 * | 2/2011 | Hiraga et al. | 451/102 |

FOREIGN PATENT DOCUMENTS

| | | |
|---|---|---|
| JP | 2549137 | 8/1996 |
| JP | 09-001460 | 1/1997 |
| JP | 2000-176840 | 6/2000 |

* cited by examiner

SURFACE TREATMENT MACHINE

TECHNICAL FIELD

This invention relates to a surface treatment machine for projecting abrasives on the surface of a workpiece and for surface treatment thereon.

BACKGROUND

One conventional surface treatment machine, as disclosed in, e.g., Patent Literature 1, blast finishes an elongated members or workpiece. In such a conventional machine, if the elongated workpiece to be blast finished is, for instance, an H steel having an H-like cross section, the H steel is positioned in an H-like position in which its web surfaces are in their lateral positions, such that abrasives are projected on to the positioned H steel for surface treatment. In this case, because the upper side of the positioned H steel is formed almost like a slot, the abrasives that have been projected may remain therein. Therefore, this type of conventional machine requires that an H steel that has been surface treated should conveyed in its I-like position, in which the web surfaces are in their longitudinal position, to prevent the abrasives that have been projected from remaining on the treated H steel. However, this conveying position of the H steel to be conveyed lacks stability. In contrast, if the H steel is conveyed in its H-like position, as described above, the abrasives that have been projected may remain thereon.

PRIOR ART LITERATURE

Patent Literature

[Patent Literature 1] Japanese Patent Publication No. 2549137 (Sintokogio, Ltd.)

SUMMARY OF THE INVENTION

Problem to be Solved by the Invention

Accordingly, one purpose of the present invention is to provide a surface treatment machine that enables the inhibition or a reduction of residual abrasives on a workpiece that has been surface treated.

Means to Solve the Problem

The surface treatment machine for surface treating a workpiece to be treated with of the present invention comprises:

- conveying equipment that forms a conveying path for conveying the workpiece along the conveying path in a conveying direction;
- a blasting device for projecting the abrasives on the conveying workpiece to be surface treated; and
- a blower for blowing gas from downstream of the blasting device along the conveying direction and above the conveying path toward the upper surface of the conveying workpiece.

With this surface treatment machine, the workpiece to be treated is conveyed by the conveying equipment. The blasting device then projects the abrasives to the conveying workpiece such that it is surface treated. In this surface treatment, downstream of the blasting device along the conveying direction, the blower blows the gas from above the conveying path to the upper surface of the workpiece such that the abrasives on the workpiece are blown off and removed therefrom.

Therefore, abrasives remaining on the workpiece can be prevented or inhibited.

In one embodiment of the present invention, the blower is preferably configured such that the streamline of the blowing gas toward the workpiece is downwardly inclined from downstream to upstream along the conveying direction.

In this configuration, because the blower blows the gas to the residual abrasives on the upper surface of the workpiece in the opposite direction of the conveying direction, the abrasives on the upper surface of the workpiece can be efficiently blown off therefrom.

The surface treatment machine of the present invention may further include a receptacle for receiving the abrasives that are blown off the workpiece by blowing gas from the blower. The receptacle is located above the conveying path downstream of the blasting device along the conveying path.

With such a receptacle, because the abrasives that are blown off the workpiece are kept therein, the falling therein and thus remaining thereon of the abrasives that are blown off the upper surface of the workpiece is prevented or inhibited.

In one embodiment of the present invention, the surface treatment machine may further comprise:

- transferring mechanism for transferring the abrasives that are projected; and
- circulating device for circulating the transferred abrasives into the blasting device.

In this configuration, because the abrasives that are projected are transferred by the transferring mechanism such that the circulating device circulates them into the blasting device, they can be reused.

In this configuration, the receptacle preferably communicates with the transferring mechanism to reuse the accommodated abrasives kept in the receptacle.

In one embodiment of the present invention, the surface treatment machine further comprises:

- a height sensor for sensing the height level of the conveying workpiece, wherein the height sensor is located on the upstream of the blower along the conveying direction; and
- a lifting and lowering device for vertically moving the blower in response to the sensing result from the height sensor.

In such an embodiment, the height sensor, which is located on the upstream of the blower along the conveying direction, senses the height level of the workpiece in its conveying condition. The lifting and lowering device vertically moves the blower in response to the sensing result from the height sensor. Therefore, the blower can be positioned at an appropriate height level relative response to the height level of the workpiece.

In such an embodiment, the height level of the lower end of the height sensor may be positioned at a height level that is the same as or lower than the height level of the lower end of the blower. Also, the surface treatment machine may further include a synchronizing mechanism for synchronizing the vertical movement of the height sensor with the vertical movement of the blower.

This configuration enables the positioning of the lower end of the height sensor to a position to avoid collision with the workpiece. Further, the synchronizing means synchronizes the vertical movement of the height sensor with the vertical movement of the blower. Therefore, a collision between the blower and the workpiece can readily be prevented.

In one embodiment of the present invention, the surface treatment machine may further comprise:

- an edge detection sensor for detecting when the leading edge and the following edge of the conveying workpiece passes therethrough, wherein the edge detection sensor is located upstream of the blasting device along the conveying direction; and a controlling means for actuating the blasting device and the blower when the controlling means determines that the workpiece on the conveying path is in a predetermined range along the conveying path, in response to a detection result from the edge detection sensor and the conveying velocity of the workpiece by means of the conveying equipment.

In such an embodiment, the edge detection sensor detects when the leading edge and the following edge of the workpiece along the conveying direction pass therethrough. Based on this detection result and the conveying velocity of the workpiece by means of the conveying equipment, the controlling means can adequately control the timing of the operation of the blasting device and the blower.

The surface treatment machine of the present invention may further comprise a further blower for blowing gas from downstream of the blower along the conveying direction and above the conveying path toward the upper surface of the conveying workpiece.

With this configuration, even in the possible case in which the abrasives on the workpiece cannot be completely removed with only the blowing of the gas from the=blower, the residual abrasives on the workpiece may be removed by the further blower. Therefore, residual abrasives on the workpiece may be effectively prevented or inhibited.

This further blower is preferably configured such that the streamline of the blowing gas toward the workpiece is downwardly inclined from downstream to upstream along the conveying direction.

The surface treatment machine of the present invention further comprises antiscattering equipment that is arranged beneath the conveying path of the workpiece and includes antiscattering members for preventing the abrasives that are projected onto the workpiece from scattering through the lower surface of the workpiece.

With this antiscattering equipment, the abrasives that are projected on the lower surface of the workpiece can be prevented from scattering through the workpiece.

The antiscattering members of the antiscattering equipment preferably include a plurality of self-standing and elongated members. Each elongated member has flexibility to deflect in the conveying direction of the workpiece when the workpiece passes through the elongated member.

In this configuration, the scattering of the abrasives can be prevented, even if the width of the workpiece is varied.

The surface treatment machine that incorporates the antiscattering equipment may further comprise a height sensor, which is located upstream of the blower along the conveying direction, for sensing the height level of the conveying workpiece; and a further for vertically moving the antiscattering equipment in response to the sensing result from the height sensor.

In this configuration, based on the detection result from the height sensor, the further lifting and lowering device vertically moves the antiscattering equipment. Therefore, the height level of the antiscattering equipment can be positioned at an appropriate height level in response to the height level of the workpiece.

The surface treatment machine of the present invention may further comprise an edge detection sensor for detecting when the leading edge and the following edge of the conveying workpiece pass therethrough; and a controlling means for suspending the conveying equipment when the controlling means determines that the time period in which a workpiece on the conveying path is nonexistent is longer than a predetermined value, in response to the detection result from the edge detection sensor.

In this configuration, the edge detection sensor, which is located upstream of the blasting device along the conveying direction, detects when the leading edge and the following edge of the conveying workpiece pass therethrough. In response to the detection result from the edge detection sensor, the controlling means suspends the operation of the conveying equipment when the controlling means determines that the time period in which a workpiece on the conveying path is nonexistent is longer than a predetermined value. Therefore, the operation of the conveying equipment can be adequately controlled.

The surface treatment machine of the present invention may further comprise a variable feeder for feeding the abrasives into the blasting device with a variable feeding rate.

In this configuration, appropriate quantities of abrasives can be adequately fed from the feeder to the blasting device.

Advantage of the Invention

As described above, the surface treatment machine of the present invention enables prevention or inhibition of residual abrasives on a workpiece that has been surface treated.

The accompanying drawings, which are incorporated in and constitute a part of the specification, schematically illustrate a preferred embodiment of the present invention, and together with the general description given above and the detailed description of the preferred embodiment given below, serve to explain the principles of the present invention.

DETAILED DESCRIPTION OF THE INVENTION

Figure 1:
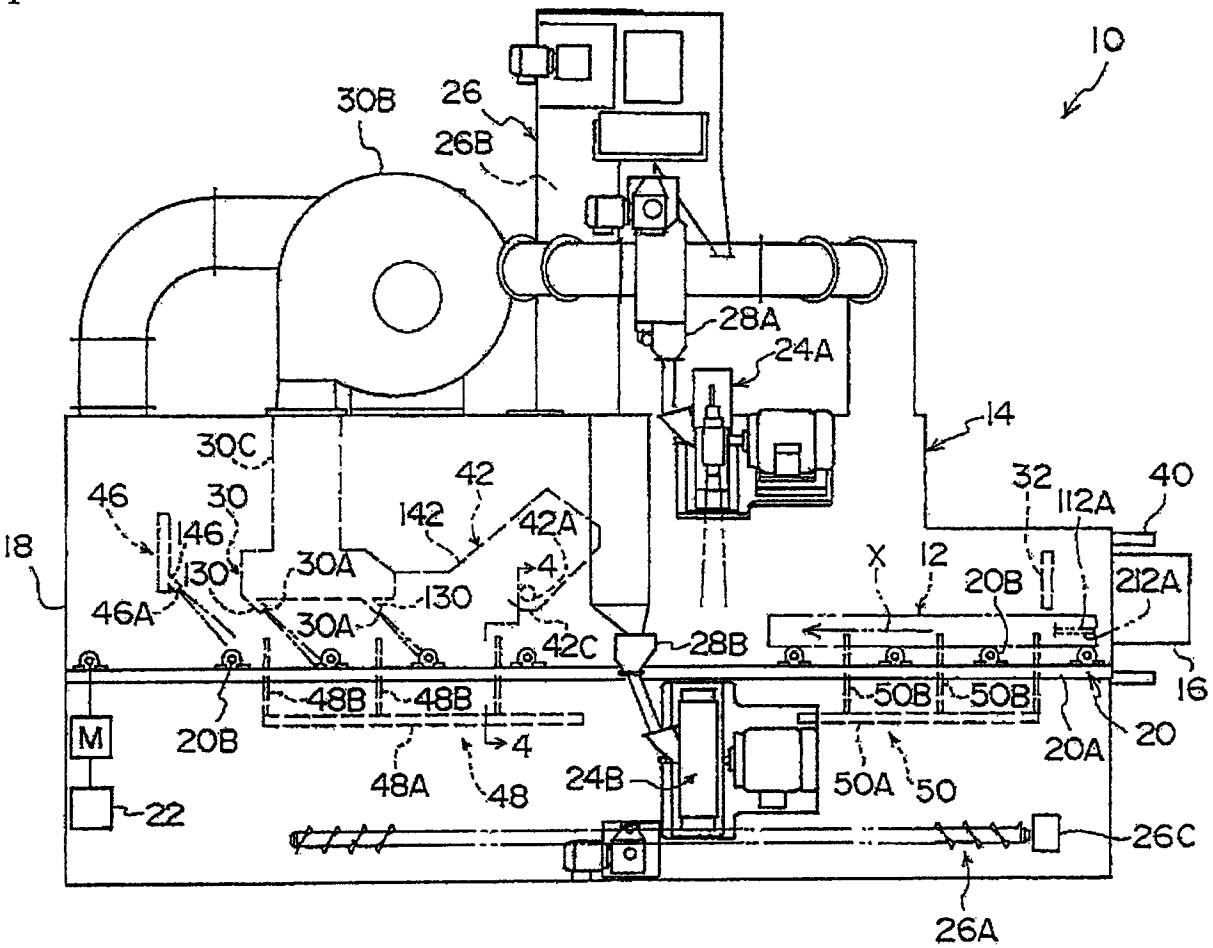
FIG. 1 is a schematic side view of a shot-blast machine of one embodiment of the present invention.
Figure 2:
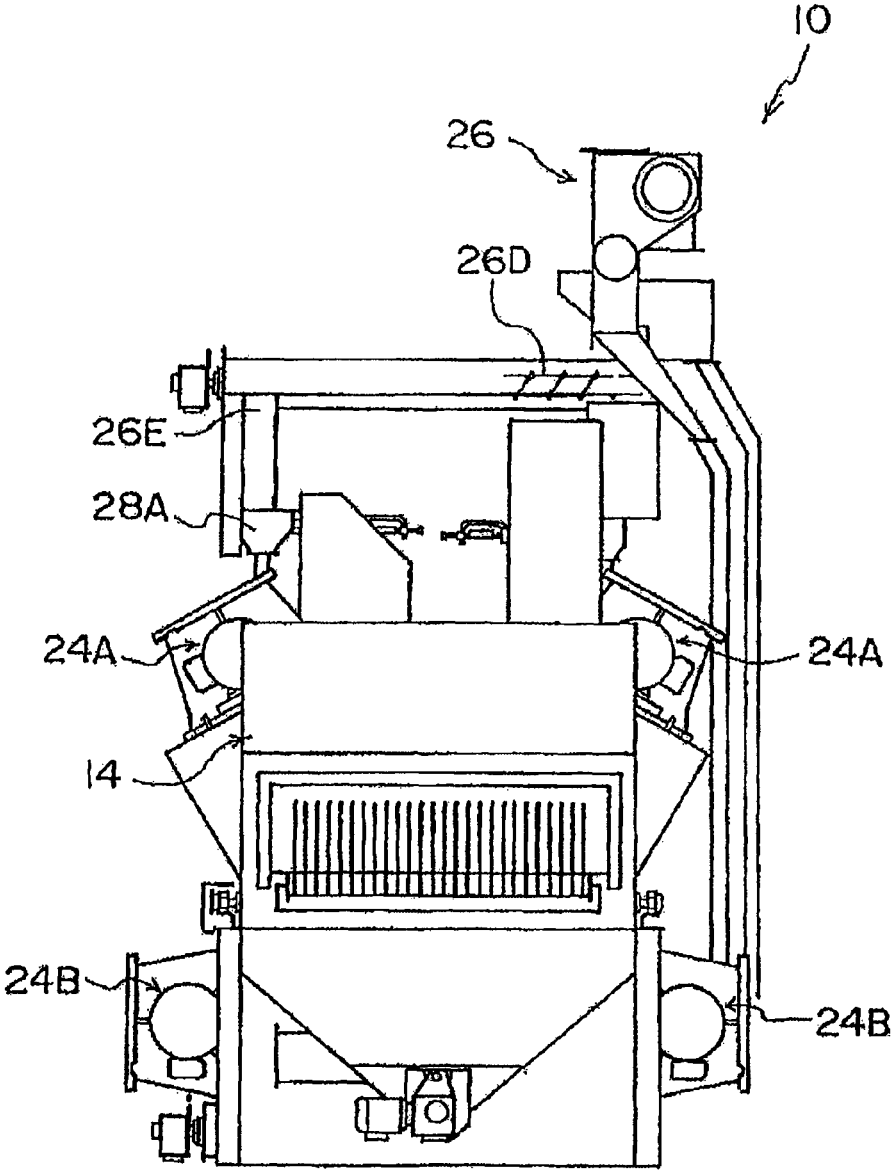
FIG. 2 is a schematic front view of the shot-blasting machine of FIG. 1.
Figure 3:
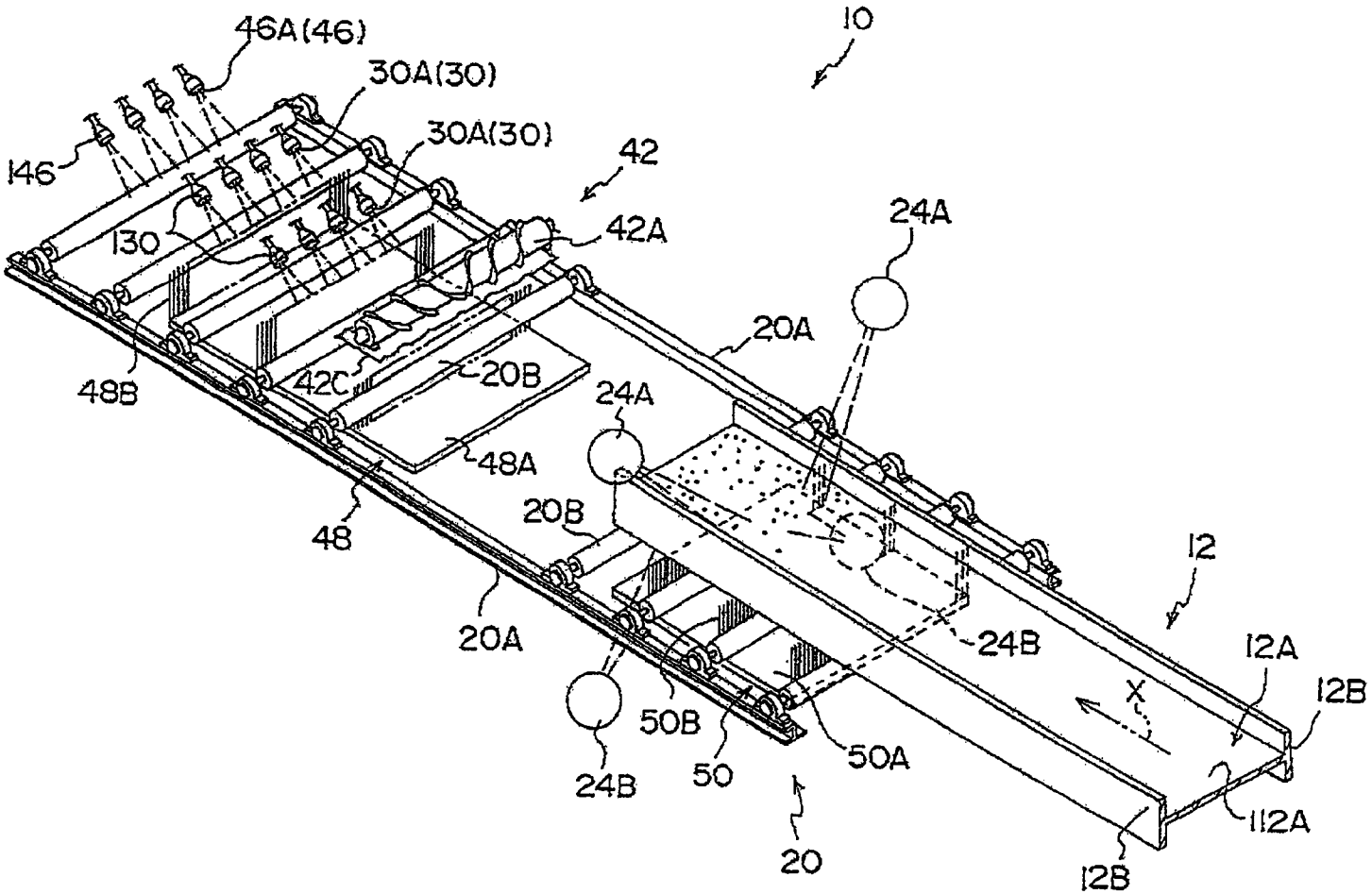
FIG. 3 is a perspective view illustrating a part of the shot-blasting machine of one embodiment of the present invention.

As one example of the surface treatment machine of one embodiment of the present invention, a shot-blasting machine 10 will be explained with reference to FIGS. 1 to 5. FIG. 1 illustrates a side view of a schematic configuration of the shot-blast machine 10 of one embodiment of the present invention. FIG. 2 illustrates the front view of a schematic configuration of the shot-blasting machine 10. FIG. 3 is a perspective view of one part of the shot-blasting machine 10 and an H steel 12 to be surface treated. In this embodiment, as illustrated in FIG. 3, note that the H steel 12 is an elongated material that includes a web 12A and a flange 12B such that it is conveyed along its longitudinal in its H-like position in which the surface of the web 12A is in a lateral position. In this conveying position of the H steel, one surface that is upwardly faced of the web 12A is referred to as the upper surface.

As illustrated in FIG. 1, the shot-blasting machine 10 includes a cabinet 14 whose interior forms an elongated treating chamber along the conveying direction (as denoted by an arrow X) of the H steel 12. The cabinet 14 forms a service entrance 16 for carrying in a workpiece at the side for carrying in (the right side in the drawing) and an outlet 18 for carrying out the workpiece at the side for carrying out (the left side in the drawing).

Interior to the cabinet 14, conveying equipment (conveying equipment) 20 for conveying the H steel 12 is provided. As illustrated in FIG. 3, the conveying equipment 20 is provided with conveying bases 20A on both sides of the width across the conveying direction. On the conveying bases 20A, a plurality of round bar-like conveying rollers 20B are rotatably supported. These rollers 20B are arranged along the conveying direction (the X-direction denoted by the arrow) such that the longitudinal of the conveying rollers 20B is perpendicular to the conveying direction with appropriate intervals adjacent them, to form a conveying path for the H steel 12. As shown in FIG. 1, the conveying rollers 20B are coupled with a driving motor M, which is schematically illustrated on the left side of FIG. 1, such that they are rotated by the driving force of the driving motor 12. Thus, the conveying equipment 20 is configured such that the H steel 12 is loaded on the conveying rollers 20B to convey it. The driving motor M is connected to an electronic control unit (ECU) (a controlling means or a controlling section) 22. The ECU 22 is illustrated as a schematic block diagram in FIG. 1.

As illustrated in FIGS. 1 and 2, blasting devices 24A and 24B (at least one blasting device) are arranged on the both sides of the ceiling and the lower portions of the lateral sides of the cabinet 14. The blasting devices 24A and 24B are, but are not limited to, centrifugal shot-blasting devices (impeller units) for centrifugally accelerating abrasives (shots) to project them in the predetermined direction.

As illustrated in FIG. 3, the upper blasting device 24A is installed on the upper side of both sides of the conveying path such that it projects the shots from obliquely and upward to the H steel 12. Although the blasting devices 24A and 24B are schematically illustrated in FIG. 3 for the convenience of explanation, they are connected to the ECU 22 that is shown in FIG. 1, but is not shown in FIG. 3.

As illustrated in FIG. 1, the blasting devices 24A and 24B are coupled to shot feeders 28A and 28B for supplying the shots thereto. Each shot-feeding device 28A or 28B is provided with an openable and closable gate (not shown) in a supplying section for supplying the shots. The shot feeders 28A and 28B can carry out a multistep and variable regulation in amount of the supplied shots to the blasting devices 24A and 24B by varying the degree of the opening of the corresponding gates. Although the variable supply for supplying the shots by means of the shot feeders 28A and 28B is the two-step supply in this embodiment, it may be replaced by a nonstop supply.

The blasting devices 24A and 24B are coupled to a circulating device 26 through the shot feeders 28A and 28B. The circulating device 26 transports the shots that have been projected from the blasting devices 24A and 24B to circulate the projected shots thereto. The circulating device 26 is provided with screw conveyors 26A, which are arranged on both sides of the bottom portion of the cabinet 14, and a bucket elevator 26B, which is vertically extended along the height of the machine. Each screw conveyor 26A is axially extended such that the direction of its shaft is along the conveying direction (the direction denoted by arrow X) of the H steel 12. The part (not shown) of the shaft of each screw conveyor 26A is rotatably supported on the cabinet 14. Each screw conveyor 26A is provided with a bilaterally symmetric screw, which is drivingly and rotatably coupled to a driving motor 26C to feed the shots from both sides the center portion in the drawing when it rotates by means of the driving motor 26C. The lower end of the bucket elevator 26B is arranged facing the upper part of the center portion of each screw conveyor 26A. The detailed explanation of the bucket elevator 26B is omitted, since it includes a well-known structure in which a plurality of pulleys (not shown) are arranged at the top and bottom of the shot-blasting machine 10 such that an endless belt (not shown) on which many buckets (not shown) are attached is entrained on the pulleys. With this configuration of the bucket elevator 26B, the buckets scoop the shots that have been collected by means of the screw conveyors 26A to transport the shots within the buckets to the upper side of the machine by rotating the pulleys by means of a motor.

Further, as illustrated in FIG. 2, in the circulating device 26, the upper side of the bucket conveyor 26B (see FIG. 1) is provided with the one end of an upper screw conveyor 26D for horizontally transporting the shots. Beneath the upper screw conveyor 26D, a shot tank 26E for storing the shots is provided. The shot tank 26E is coupled to the shot feeders 28A, 28B (see FIG. 1).

Also, as illustrated in FIGS. 1 and 3, a blowing port 30A of an air blower 30 is arranged at the side downstream of the blasting devices 24A, 24B and above the conveying path. As illustrated in FIG. 1, the air blower 30 includes a blower fan 30B, which is provided on the upper portion of the cabinet 14. The blower fan 30, which is operated by means of a driving force of a driving motor (not shown), is coupled on a duct 30C. The lower portion of the duct 30C forms a vertically movable part and a nozzle portion 130 having the blowing port 30A at the tip of the lower portion of the duct 30C. The air blower 30 can be gas (air) blown from the blowing port 30A to the upper surface 112A of the H steel 12 when the driving motor is driven.

The air blower 30 is preferably configured such that the direction of the streamline of the gas to be blown to the workpiece is downwardly inclined from the downstream to the upstream along the conveying direction. To this end, in this embodiment, the orientation of the gas to be blown from the air blower 30 is established by an inclination angle of the nozzle portion 130. Namely, the blown gas from the air blower 30 is established such that the direction of the streamline of the blown gas is downwardly inclined from the downstream to the upstream along the conveying direction. In addition, the driving motor (not shown) of the blower fan 30B is controllably coupled to the ECU 22.

Upstream side of the conveying direction of the air blower 30, a transferring mechanism 42 is disposed such that it is coupled to and integrated with the air blower 30. The transferring mechanism 42 includes a housing 142 whose lower portion has a lower opening near the air blower 30 such that the lower opening faces to the conveying path. Note that the housing 142 in FIG. 1 is schematically illustrated as its cross section that includes the lower opening. The housing 142 is integrally provided with a backing plate 42C at the location adjacent to the lower opening of the housing 142 and upstream of the conveying direction. The baking plate 42C is arranged such that its height level is substantially the same as that of the blowing port 30A of the air blower 30.

Further, as illustrated in FIGS. 1 and 3, the transferring mechanism 42 includes a screw conveyor 42A in proximity to above the backing plate 42C. In this embodiment, the backing plate 42C forms a receptacle for collecting the shots such that the receptacle is located downstream of the conveying direction and above the conveying path. The backing plate 42C is configured to receive the shots that are blown off the H steel 12, especially the shots that are blown off the upper surface 112A of the H steel 12, i.e., the shots that are lifted up with the reflected gas from the upper surface 112 of the H steel 12. The screw conveyor 42A is extended along its axial direction that is oriented widthwise, which corresponds to a perpendicular line against the plane of FIG. 1, of the conveying direction and is opposed to the receptacle (the backing plate) 42C.

Figure 4:
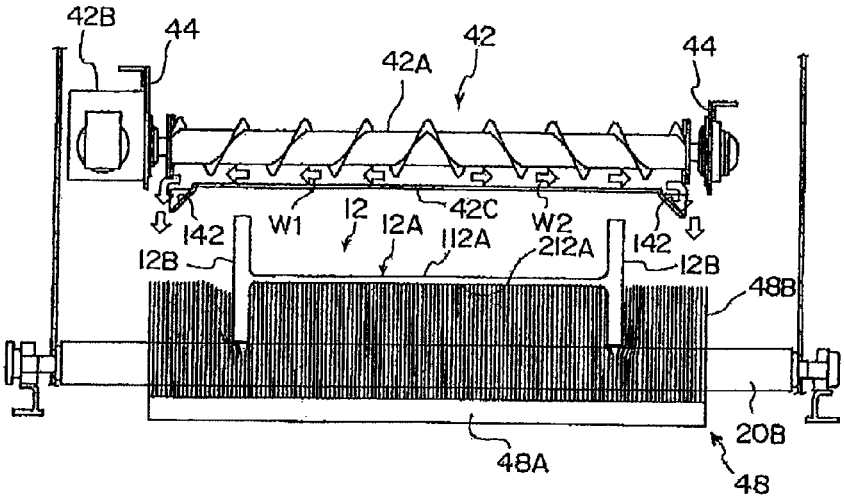
FIG. 4 is an enlarged cross-sectional view along 4-4 lines in FIG. 1.

FIG. 4 illustrates an enlarged cross-section view along 4-4 lines in FIG. 1. As illustrated in FIG. 4, a shaft of the screw conveyor 42A is rotatably supported by brackets 44 on both sides. The brackets 44 are coupled to one portion of the air blower 30 that is shown in FIG. 1.

The screw conveyor 42A is provided with a bilaterally symmetric screw, which is drivingly and rotatably coupled to a driving motor 42B to feed the shots on the backing plate 42C from the center portion to both sides (denoted by arrows W1 and W2) in the drawing when it rotates by means of the driving motor 42B. The backing plate 42C forms a discharging opening 142 at the outside more than the H steel 12 in the width of the conveying direction, to allow the shots to fall downward. The discharging opening 142 is located above the screw conveyor 26A in the bottom portion of the cabinet 1 as illustrated in FIG. 1. Transferring mechanism 42 thus transfers the shots, which are blown off the upper surface 112A of the H steel 12 caused by the blown gas from the air blower 30, to the circulating device 26.

As illustrated in FIGS. 1 and 3, a blowing port 46A of a final blower (a further blower) 46 is located downstream of the air blower 30 in the conveying direction and above the conveying path. The blowing port 46A is formed on the tip end of a nozzle 146 of the final blower 46. In this embodiment, a lower portion (a movable portion) of the final blower 46 can be moved with a lower portion (a movable portion) of the air blower 30 in unison. The blowing port 46A of the final blower 46 is located slightly higher than the blowing port 30A of the air blower 30. The final blower 46 is configured such that the blowing port 46A can blow compressed air (or compressed gas) toward the upper surface 112A of the H steel 12. Similar to the air blower 30, the final blower 46 is preferably configured such that the direction of the streamline of the gas to be blown to the workpiece is downwardly inclined from the downstream to the upstream along the conveying direction. To this end, in this embodiment, the orientation of the streamline of the gas to be blown from the blowing port 46A of the final blower 46 is established such that it is downwardly inclined from the downstream to the upstream along the conveying direction.

As illustrated in FIG. 1, a height sensor 32, which also functions as a collision avoidance device, is located upstream of the air blower 30 and the blasting devices 24A, 24B in the conveying direction. The height sensor 32 senses the height level of an incoming workpiece under the conveying condition. As in this embodiment, if the workpiece 12 is the H steel, the height level to be sensed by the height sensor 32 is positioned on the top end of the flange of the H steel 12.

Figure 5:
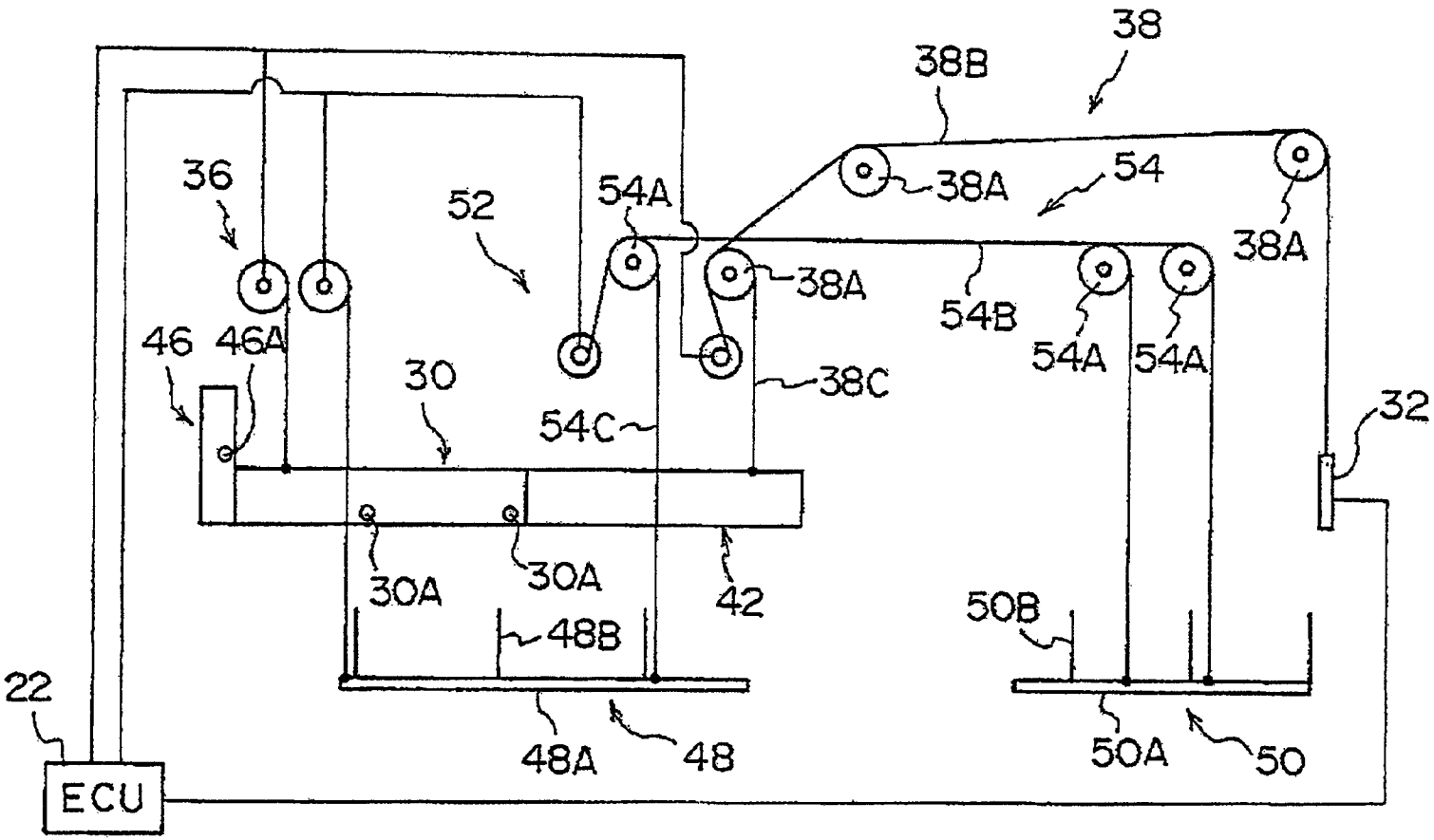
FIG. 5 is a schematic side view illustrating the vertical moving mechanism in the shot-blasting machine of one embodiment of the present invention.

As illustrated in FIG. 5, the height sensor 32 is coupled to a first lifting and lowering device (a first lifting and lowering means) 36 through the ECU 22. The first lifting and lowering device 36 is configured to have a winch. The first lifting and lowering device 36 lifts and lowers the movable portion on the side of the blowing port 30A of the air blower 30 to a position in which the air blower 30 cannot contact with the H steel 12 that is shown in FIG. 1, and lifts and lowers the movable portion of the final blower 46 in unison.

In this embodiment, the height level of the lower end of the height sensor 32 is positioned on a level substantially the same as the height level of the lower end of the air blower 30. Alternatively, the height level of the lower end of the height sensor 32 may be positioned on a level that is slightly lower the height level of the lower end of the air blower 30. The height sensor 32 is preferably coupled to the air blower 30 thorough a gearing mechanism 38. The gearing mechanism 38 includes a wire 38B and a chain 38C, both entrained on a pulley 38A to couple the height sensor 32 with the air blower 30 to interlock the vertical motion (the vertical displacement) of the height sensor 32 with the vertical motion (the vertical displacement) of the air blower 30.

As illustrated in FIG. 1, in the upstream of the blasting devices 24A, 24B, an edge detection sensor 40 is located in proximity to a service entrance 16. The edge detection sensor 40 detects events in which the leading edge and the following edge of the H steel are passed and generates detection signals. The edge detection sensor 40 is coupled to and provides detection signals to the ECU 22 (its coupling manner is not shown). Based on the detection results of the edge detection sensor 40 and the setting velocity of the conveying roller 20B (i.e., the conveying velocity of the conveying device 20), if the ECU 22 determines that the H steel 12 is in a predetermined range on the conveying path along the conveying direction (the direction denoted by an arrow X), the ECU 22 actuates the blasting devices 24A, 24B and the air blower 30. Based on the detection results of the edge detection sensor 40, if the ECU 22 determines that the time period in which the H steel 12 on the conveying path is nonexistent is longer than a predetermined value, the ECU 22 suspends the driving motor M to hold the operation of the conveying device 20.

As illustrated in FIGS. 1 and 3, antiscattering equipment 48, 50 is arranged beneath the conveying path of the H steel 12. The antiscattering equipment 48, 50 includes supporting brackets 48A, 50A, which are horizontally arranged along the conveying path, and a plurality of antiscattering members 48B, 50B, which are arranged on the supporting brackets 48A, 50A along the conveying direction (the direction denoted by the arrow X). The antiscattering members 48B, 50B compose of a highly resilient (elastic) material such as a resin. The lower ends of the antiscattering members 48B, 50B are fixed on the supporting brackets 48A and 50A. As illustrated in FIG. 4, the antiscattering members 48B, 50B are configured by a plurality of self-standing, elongated, flexible members such that they deflect to the conveying direction of the H steel 12 when it passes through them. The antiscattering members 48B, 50B illustrated in FIG. 1 thus prevent the projected shots on the lower surface 212A of the H steel 12 from scattering therethrough.

As illustrated in FIG. 5, the antiscattering members 48B, 50B are coupled to a second lifting and lowering device (a lifting and lowering means) 52. In turn, the second lifting and lowering device 52 is coupled to the height sensor 32 through the ECU 22. The second lifting and lowering device 52 is configured to have a winch. Based on the detection results of the height sensor 32, the ECU 22 instructs that the second lifting and lowering device 52 lift and lower the antiscattering equipment 48, 50 (see FIG. 5) to the height level in which the top edges of them contact with the lower surface 212A of the H steel 12, as illustrated in FIG. 4.

In this embodiment, the detection results of the height sensor 32 to detect the height level of the H steel 12 are used in the vertical motion of the antiscattering equipment 48, 50 by means of the second lifting and lowering device 52 and the vertical motion of the air blower 30 by means of the first lifting and lowering device 36.

In this embodiment, as illustrated in FIG. 5, the downstream antiscattering equipment 48 and the upstream antiscattering equipment 50 that are located on the sides downstream and upstream of the conveying direction are coupled to each other through a synchronization mechanism 54. The synchronization mechanism 54 includes a wire 54B and a chain 54C, both entrained on a pulley 54A to couple the antiscattering equipment 48 with the antiscattering equipment 50 to interlock the vertical motion (the vertical displacement) of the antiscattering equipment 48 with the vertical motion (the vertical displacement) of the antiscattering equipment 50.

Below the operation of the shot-blasting machine 10 will be explained, while the function and the advantage of the above embodiment will be explained.

As illustrated in FIG. 1, when the H steel 12 in its H-like position (in which the web surfaces are in their lateral position) is carried in the shot-blasting machine from the service entrance 16, the edge sensor 40 detects when both edges (the leading edge and the following edge) of the conveying direction of the H steel 12 pass through to rotate the conveying rollers 20B to convey it to the conveying direction (the direction denoted by the arrow X). Based on the detection results of the edge detection sensor 40 and the setting velocity of the conveying roller 20B (i.e., the conveying velocity of the conveying device 20), if the ECU 22 determines that the H steel 12 is in a predetermined range on the conveying path along the conveying direction (the direction denoted by an arrow X), the blasting devices 24A, 24B and the air blower 30 are actuated by instruction from the ECU 22.

Specifically, under the control of the ECU 22, the operations of the blasting devices 24A, 24B begin immediately before the H steel 12 arrives at the blasting area where the shots are projected and are then completed immediately after the H steel 12 passes through the blasting area. Also, the operation of the air blower 30 begins immediately before the H steel 12 arrives at the blowing area where the air is blown and is then completed immediately after the H steel 12 passes through the blowing area. These controls inhibit unnecessary operations.

When the blasting devices 24A, 24B are actuated, the H steel 12 is shot-blasted by means of the shots projecting from the blasting devices 24A, 24B. As a result, some of the shots remain on the upper surface 112A of the H steel 12. Under this condition, the air blower 30 blows gas to the upper surface 112A of the H steel 12 to blow away and to remove the residual shots therefrom. Namely, the residual shots can be removed without contacting the H steel 12 with any brushing means for brushing off the shots.

Because the air blower 30 is configured such that the direction of the streamline of the gas to be blown is downwardly inclined from the downstream to the upstream along the conveying direction, the gas is blown to the residual shots on the upper surface 112A of the H steel 12 in the opposite direction of the conveying direction. Therefore, the shots on the upper surface 112A of the H steel 12 can be efficiently blown away therefrom.

As described above, downstream of the blasting devices 24A, 24B and in the upstream direction of the air blower 30 in the conveying direction, the backing plate (the receptacle) 42C for receiving and accommodating the shots that are blown off the upper surface 112A of the H steel 12 due to the blowing of the gas from the air blower 30 and the screw conveyor 42A are provided above the conveying path. With this arrangement, the case which the blown up shots return to the upper surface 112A of the H steel 12 can be prevented or reduced.

With the shot-blasting machine 10 of this embodiment, the residual shots on the H steel 12 thus can be prevented or reduced even when the H steel 12 is subjected to a blasting (a surface treating), while it is conveyed in its H-like position.

To remove the shots from the H steel 12 in the conventional surface treatment machine, one possible configuration may incorporate a contact-type removal means for removing the shots, typically a rotating brush and a fixed scraper. Such a configuration, however, involves disadvantages in which the shots cannot be sufficiently removed if the removal means is worn; the distance between the H steel 12 and the removal means should be fine adjusted on a case-by-case basis; and unnecessary dust generates as the rotating brush or other removal means become worn. In contrast, the shot-blasting machine 10 of this embodiment is free from these disadvantages. Further, with the shot-blasting machine 10 of this embodiment, a worker's labor to manually remove the shots on the H steel 12 after projecting the shots can be eliminated or completed in a significantly shorter time.

As illustrated in FIG. 4, the shots blown up on the backing plate 42C convey from the center to both sides of the axial direction (directions denoted by arrows W1 and W2) of the screw conveyor 42A. The conveyed shots then fall out of the exhaust 142 at both sides of the screw conveyor 26A in the bottom of the cabinet 14 (as shown in FIG. 1). The shots that are blown up from the upper surface 112A of the H steel 12 by means of the blowing gas from the air blower 30 then transfers to the circulating device 26.

In the circulating device 26, the shots that are conveyed to the lower side of the bucket elevator 26B through the screw conveyor 26A are then conveyed to the upper side of the machine 10 by means of the bucket elevator 26B. The shots are then passed through the upper screw conveyor 26D and the shot tank 26E (both shown in FIG. 2) such that they are fed from the shot feeders 28A, 28B (as shown in FIG. 1) to the blasting devices 24A, 24B. In other words, the projected shots are circulated to the blasting devices 24A, 24B through the circulating device 26. Further, because the feed rate of the shots to be fed from each shot feeder 28A or 28B (as shown in FIG. 1) to the corresponding blasting device 24A or 24B can be variably controlled by adjusting a degree of opening of a gate, the appropriate quantities of the shots can be fed to the blasting devices 24A, 24B.

Also, in this embodiment, the height sensor 32, which is equipped on the side of the service entrance 16, detects the height of the incoming H steel 12 in its conveying condition. In response to a detection result from the height sensor 32, the first lifting and lowering device 36 vertically moves the air blower 30 (as shown in FIG. 5). The air blower 30 is thus positioned at the appropriate height level in relation to the height of the H steel 12 (see FIG. 1) to blow away the shots on the upper surface 112A (see FIG. 1) of the H steel 12.

Further, the height level of the lower end of the height sensor 32 is positioned to the same height as that of the lower end of the air blower 30, while the vertical movement of the height sensor 32 gears or synchronizes with that of the air blower 30 through the gearing mechanism 38. Therefore, positioning the lower end of the height sensor 32 to a height level on which it is free from a collision with the H steel 12 (see FIG. 1) causes the air blower 30 to avoid colliding with the H steel 12.

As illustrated in FIG. 1, in this embodiment, the blowing port 46A of the final blower 46 is located above the conveying path downstream of the air blower 30 in the conveying direction such that the final blower 46 can blow the gas toward the upper surface 112A of the H steel 12. With this configuration, even in the possible case in which the shots on the H steel 12 cannot be completely removed with only the blowing of the gas from the air blower 30 and thus the shots are still partially remained thereon, the residual shots on the H steel 12 may be removed by means of the blowing of the gas from the final blower 46.

Beneath the conveying path of the H steel 12, the antiscattering members 48B,50B of the antiscattering equipment 48, 50 are arranged to prevent the projected shots on the lower surface 212A of the H steel 12 from scattering around the periphery of the machine. As described above, the antiscattering members 48B, 50B are configured by a plurality of self-standing, elongated, flexible members such that they deflect to the conveying direction (denoted by the arrow X) of the H steel 12 when it passes through them. Therefore, the scattering of the shots can be prevented, even if the width of the H steel 12 varies when it is conveyed in the H-like position. As illustrated in FIG. 5, in response to the detection result from the height sensor 32, the second lifting and lowering device 52 vertically moves the antiscattering members 48B, 50B. The antiscattering equipment 48, 50 is thus positioned at the appropriately height level in response to the height of the H steel 12 (see FIG. 1).

When the H steel 12 as shown in FIG. 1 conveys out from the shot-blasting machine and thus the ECU 22 determines that the time period in which H steel 12 on the conveying path is nonexistent is longer than a predetermined value in response to the detection result from the edge detection sensor 40, the driving motor M is suspended by instructions from the ECU 22 to hold the operation of the conveying device 20.

As described above, in this embodiment, the air blower 30 is configured such that the direction of the streamline of the gas to be blown is downwardly inclined from the downstream to the upstream along the conveying direction. This configuration is preferable in view of the efficiency of blowing out the shots on the upper surface 112A of the H steel 12 (the workpiece to be treated). However, the orientation of the direction of the gas to be blown from the blower is not limited to this configuration. That is, the blowing gas from the blower may be configured such that the direction of the streamline of the flowing gas may be downwardly inclined, or it may be downwardly inclined toward the downstream along the conveying direction.

In the above embodiment, although the orientation of the direction of the blowing gas from the air blower 30 is controlled by adjusting the tilting angle of the nozzle 130 of the air blower 30, it may be controlled by means of another configuration. For instance, a deflection plate may be arranged adjacent to the blowing port of the blower such that the orientation of the direction of the blowing gas may be controlled by adjusting the positions of the deflection plate.

Further, in the above embodiment, the backing plate (the receptacle) 42C for receiving and accommodating the shots that are blown up from the upper surface 112A of the H steel 12 and the screw conveyor 42A are incorporated. This configuration is more preferable in view of inhibiting or preventing an event in which the shots that are blown up from the upper surface 112A of the H steel (the workpiece to be treated) 12 are returning thereto. However, one embodiment eliminating both the backing plate 42B and the screw conveyor 42A may also be possible.

Also, in the above embodiment, the transferring mechanism 42 transfers the shots that are blown up from the upper surface 112A of the H steel 12 by means of the blowing gas from the air blower 30 to the circulating device 26. This configuration is more preferable in view of reusage of the shots that are blown up from the upper surface 112A of the H steel (the workpiece to be treated) 12. However, one embodiment eliminating the transferring mechanism 42 may also be possible. Although the shot-blasting machine (the surface treatment machine) 10 is preferably configured with the transferring mechanism 26, one surface treatment machine eliminating the transferring mechanism may be established.

In the above embodiment, the first lifting and lowering device 36 vertically moves the movable portion of the side of the blowing port 30A of the air blower 30, the movable portion of the final blower 46, and the height sensor 32, while the second lifting and lowering devise 52 vertically moves the antiscattering equipment 48, 50. The respective portions to be vertically moved by means of the first and second lifting and lowering devices 36 and 52 may be configured such that they are vertically moved manually instead of by the lifting and lowering devices 36 and 52.

In the above embodiment, the first lifting and lowering devise 36 vertically moves the movable portion of the side of the blowing port 30A of the air blower 30 automatically, in line with the instructions from the ECU 22 in response to the detection result from the height sensor 32. Instead of this configuration, an alternative configuration may be configured. For instance, an operator may manually input data for the detection result from the height sensor 32 to a terminal that is coupled to the ECU 22. In response to the inputted data, the ECU 22 may then causes the first lifting and lowering devise 36 or other lifting and lowering means to vertically move the movable portion of the side of the blowing port of the blower.

Although the air blower 30 and other components are vertically moved in response to the detection result from the height sensor 32 in the above embodiment, an alternative embodiment may be configured. For instance, in response to the detection result from the height sensor 32, the ECU 22 may predict an event in which the air blower 30 collides with the H steel 12 to suspend the driving motor M of the conveying roller 20B. The ECU 22 may then generate an auditory or visual alarm (for instance, an alarm tone or an indication shown on a display) to urge the operator to readjust the height level by means of the first lifting and lowering device 36 (see FIG. 5).

In the above embodiment, the ECU 22 actuates the blasting devices 24A, 24B and the air blower 30 when it determines that the H steel 12 is in the predetermined range along the conveying direction (denoted by the arrow X) on the conveying path, in response to the detection result from the edge detection sensor 40 and the setting velocity of the conveying roller 20B (or the conveying velocity of the conveying devise 20). However, an alternative embodiment may be configured such that the ECU 22 actuates the blasting devices and the blower when it determines that the workpiece to be treated is in a predetermined range along the conveying direction on the conveying path, in response to, for instance, a detection result on which the leading edge of the workpiece is detected by the edge detection sensor for detecting the edge of the workpiece along the conveying direction, pre-entered information about the length of the workpiece along the conveying direction, or the conveying velocity of the conveying device.

To more effectively inhibit or prevent the shots from remaining on the workpiece (the H steel 12 as in the above embodiment), as described above, the final blower (a further=blower) 46 is preferably provided. However, one embodiment eliminating the final blower may be possible.

To prevent the shots that are projected on the lower surface 212A of the workpiece from scattering through therefrom, as described above, the antiscattering equipment 48, 50 is preferably provided. However, one embodiment eliminating the antiscattering equipment may be possible.

In the above embodiment, the antiscattering members 48B, 50B are configured by a plurality of self-standing, elongated, flexible members such that they deflect the conveying direction of the workpiece when it passes through them. This configuration is preferable in view of accommodating different H steels 12 having various widths. However, in a case in which trajectories of the scattering shots from the workpiece can be expected, for instance, when shape of the incoming workpiece and its loading position in the width direction across the conveying direction are preliminarily specified, the antiscattering members may be a cover that is located such that it intercepts the expected trajectories of the scattering shots.

In the above embodiment, the second lifting and lowering device 52 vertically moves the antiscattering equipment 48, 50 such that the top ends of the antiscattering members 48B, 50B are positioned on the height level at which those top ends contact to the lower surface 212A of the H steel 12 (see FIG. 1), in line with the instructions from the ECU 22 in response to the detection result from the height sensor 32. Instead of this configuration, an alternative configuration may be configured. For instance, an operator may manually input data for the detection result from the height sensor 32 to a terminal that is coupled to the ECU 22. In response to the inputted data, the ECU 22 may cause the second lifting and lowering devise 52 or other lifting and lowering means to vertically move the antiscattering equipment.

In the above embodiment, the ECU 22 suspends the driving motor M to hold the operation of the conveying device 20 when the ECU 22 determines that the time period in which the H steel 12 on the conveying path is nonexistent longer than a predetermined value, in response to the detection result from the edge detection sensor 40. This configuration is preferable in view of an appropriate control for the operation of the conveying device 20. However, an alternative embodiment may be configured such that the ECU 22 generates an auditory or visual alarm (for instance, an alarm tone or an indication shown on a display) to urge the operator to hold the operation of the conveying device when the ECU 22 determines that the time period in which the workpiece on the conveying path is nonexistent is longer than the predetermined value, in response to the detection result from the edge detection sensor 40.

In view of the fact that an adequate feed of the shots to the blasting devices 24A, 24B is achieved, as described above, the embodiment preferably incorporates the shot feeders 28A, 28B that enable the variable control of the feed rate of the shots to be fed to the blasting devices 24A, 24B. However, an embodiment incorporating shot feeders for feeding shots to the blasting devices at a constant feed rate, instead of the variable shot feeders, may be possible.

Although the surface treatment machine in the above embodiment is the shot-blasting machine 10, the surface treatment machine of the present invention is not limited to it, and thus may be applicable to such machines as a surface treatment machine for shot peening, or for surface treating with other abrasives.

Although the workpiece to be treated in the above embodiment is the H steel that has an H-like cross section, it may be a U-section steel with a U-like cross section or a J-section steel with a J-like cross section, or so forth. The surface treatment machine of the present invention may be applicable to a surface treatment in which the U-section steel conveys in its U-like position or the J-section steel conveys in its J-like position.

The forgoing descriptions are intended for an illustrative purpose rather than a limitation on the present invention. For instance, the above embodiments and their modifications may be adequately combined. Further, in consideration of the forgoing descriptions, those skilled in the art may be conceived various modifications without departing from the scope of the present invention recited in the claims.

BRIEF DESCRIPTIONS OF NUMERAL

10 Shot-blasting machine (Surface treatment machine)
12 H steel (Workpiece to be treated)
20 Conveying device
22 ECU (Controller)
24A, 24B Blasting devices
26 Circulating device
30 Air blower
30A Blowing port
32 Height sensor
36 First lifting and lowering device
38 Gearing mechanism
40 Edge detection sensor
42 Transferring mechanism
42A Screw Conveyor
42 Bucking plate (Receptacle)
46 Final blower (Further blower)
46A Blowing port
48, 50 Antiscattering equipment
48B, 50B Antiscattering members
52 Second lifting and lowering device (Further lifting and lowering device)

The invention claimed is:

1. A surface treatment machine for surface treating a workpiece to be treated with abrasives, the machine comprising:
- conveying equipment that forms a conveying path for conveying the workpiece along the conveying path in a conveying direction;
- a blasting device for projecting the abrasives to the conveying workpiece to be surface treated;
- a blower for blowing gas from the downstream of the blasting device along the conveying direction and above the conveying path toward the upper surface of the conveying workpiece;
- a height sensor for sensing a height level of the conveying workpiece, wherein the height sensor is located upstream of the blower and along the conveying direction; and
- a lifting and lowering device for vertically moving the blower in response to a result that is sensed by the height sensor.

2. The surface treatment machine of claim 1, wherein the blower is configured such that the streamline of the blowing gas toward the workpiece is downwardly inclined from the downstream to the upstream along the conveying direction.

3. The surface treatment machine of claim 1 or 2, wherein the machine further includes a receptacle for receiving the abrasives that are blown up from the workpiece by blowing the gas from the blower, wherein the receptacle is located above the conveying path in the downstream of the blasting device along the conveying path.

4. The surface treatment machine of claim 3, the machine further comprising:
- a transferring mechanism for transferring the abrasives that are projected; and
- a circulating device for circulating the transferred abrasives into the blasting device.

5. The surface treatment machine of claim 4, wherein the receptacle is integrated with the transferring mechanism.

6. The surface treatment machine of claim 3, the machine further comprising:

an edge detection sensor for detecting when the leading edge and the following edge of the conveying workpiece passes therethrough, wherein the edge detection sensor is located upstream of the blasting device along the conveying direction; and a controlling unit for actuating the blasting device and the blower when the controlling unit determines that the workpiece on the conveying path is in a predetermined range along the conveying path, in response to a detection result from the edge detection sensor and the conveying velocity of the workpiece by means of the conveying equipment.

7. The surface treatment machine of claim 3, the machine further comprising a further blower for blowing gas from the downstream of the blower along the conveying direction and above the conveying path toward the upper surface of the conveying workpiece.

8. The surface treatment machine of claim 1 or 2, the machine further comprising:

a transferring mechanism for transferring the abrasives that are projected; and a circulating device for circulating the transferred abrasives into the blasting device.

9. The surface treatment machine of claim 1 or 2, wherein a height level of the lower end of the height sensor is positioned at a height level that is the same as or lower than the height level of the lower end of the blower; and wherein the surface treatment machine further includes a synchronizing mechanism for synchronizing the vertical movement of the height sensor with the vertical movement of the blower.

10. The surface treatment machine of claim 1 or 2, the machine further comprising:

an edge detection sensor for detecting when the leading edge and the following edge of the conveying workpiece passes therethrough, wherein the edge detection sensor located upstream of the blasting device along the conveying direction; and a controlling unit for actuating the blasting device and the blower when the controlling unit determines that the workpiece on the conveying path is in a predetermined range along the conveying path, in response to a detection result from the edge detection sensor and the conveying velocity of the workpiece by means of the conveying equipment.

11. The surface treatment machine of claim 1 or 2, the machine further comprising a further blower for blowing gas from the downstream of the blower along the conveying direction and above the conveying path toward the upper surface of the conveying workpiece.

12. The surface treatment machine of claim 11, wherein the further blower is configured such that the streamline of the blowing gas toward the workpiece is downwardly inclined from the downstream to the upstream along the conveying direction.

13. The surface treatment machine of claim 1 or 2, the machine further comprising antiscattering equipment that is arranged beneath the conveying path of the workpiece and includes antiscattering members for preventing the abrasives that are projected to the workpiece from scattering through the lower surface of the workpiece.

14. The surface treatment machine of claim 13, wherein the antiscattering members include a plurality of self-standing and elongated members, wherein each elongated member has the flexibility to deflect to the conveying direction of the workpiece when the workpiece passes through the elongated member.

15. The surface treatment machine of claim 13, the machine further comprising:

a lifting and lowering device for vertically moving the antiscattering equipment in response to the sensing result from the height sensor.

16. The surface treatment machine of claim 1 or 2, the machine further comprising:

an edge detection sensor for detecting when the leading edge or the following edge of the conveying workpiece passes therethrough, wherein the edge detection sensor is located on the upstream of the blasting device along the conveying direction;

controlling unit for suspending the operation of the conveying equipment when the controlling unit determines that a time period in which workpiece on the conveying path nonexistent is over that a predetermined value, in response to a detection result from the edge detection sensor.

17. The surface treatment machine of claim 1 or 2, the machine further comprising a variable feeder for feeding the abrasives into the blasting device with a variable feeding rate.

* * * * *